US012274314B2

(12) United States Patent
Coates

(10) Patent No.: US 12,274,314 B2
(45) Date of Patent: Apr. 15, 2025

(54) INCONTINENCE UNDERGARMENT AND INCONTINENCE SYSTEM

(71) Applicant: Tailored Technologies, Inc., Winston-Salem, NC (US)

(72) Inventor: Fredrica V. Coates, Winston-Salem, NC (US)

(73) Assignee: Tailored Technologies, Inc., Winston-Salem, NC (US)

( * ) Notice: Subject to any disclaimer, the term of this patent is extended or adjusted under 35 U.S.C. 154(b) by 0 days.

(21) Appl. No.: 18/611,238

(22) Filed: Mar. 20, 2024

(65) Prior Publication Data

US 2024/0315356 A1 Sep. 26, 2024

Related U.S. Application Data

(60) Provisional application No. 63/453,400, filed on Mar. 20, 2023.

(51) Int. Cl.
*A41B 9/00* (2006.01)
*A41B 9/12* (2006.01)

(52) U.S. Cl.
CPC ..... *A41B 9/12* (2013.01)

(58) Field of Classification Search
CPC ..... A41B 9/12; A41B 9/00; A61B 13/15
See application file for complete search history.

(56) References Cited

U.S. PATENT DOCUMENTS 2,102,359 A * 12/1937 Frieman ..... A61F 13/72 604/397
3,459,181 A * 8/1969 Mann ..... A41B 9/02 2/403
3,599,638 A * 8/1971 Rickard ..... A61F 13/496 604/398
3,613,686 A * 10/1971 De Woskin ..... A61F 13/74 604/397
4,044,769 A * 8/1977 Papajohn ..... A61F 13/76 604/397
4,352,356 A * 10/1982 Tong ..... A61F 13/74 604/397
4,421,512 A * 12/1983 Papajohn ..... A61F 13/76 604/396
4,718,902 A * 1/1988 Bonito ..... A61F 13/49006 604/396
5,093,935 A * 3/1992 Countee, Jr. ..... A41B 9/02 2/403
5,188,626 A * 2/1993 Toyoda ..... A61F 13/49011 604/385.27

(Continued)

*Primary Examiner* — Richale L Quinn
(74) *Attorney, Agent, or Firm* — Suiter Swantz IP

(57) ABSTRACT

An incontinence undergarment including a main body and a sling positioned within and attached to the main body. A middle portion of the sling is free of attachment to a groin portion of the main body. The middle portion of the sling forms a pocket configured to hold an absorbent pad. A second pocket is positioned at one end of the sling and is configured to hold a spare absorbent pad. In embodiments, the first pocket is dimensioned to hold the absorbent pad in an unfolded state and the second pocket is dimensioned to hold the spare absorbent pad in a folded state. In embodiments, stitching delimits the boundary between the first and second pockets, and in embodiments the second pocket is an extension of one end of the sling.

9 Claims, 11 Drawing Sheets

(56) References Cited

U.S. PATENT DOCUMENTS

D339,219 S * 9/1993 Beauchemin ..... D2/713
5,241,710 A * 9/1993 Lockhart ..... A61F 13/74 2/400
5,360,422 A * 11/1994 Brownlee ..... A61F 13/505 604/397
5,489,283 A * 2/1996 Van Tillburg ..... A61F 13/4752 604/389
5,601,544 A * 2/1997 Glaug ..... A61F 13/4942 604/385.28
5,711,034 A * 1/1998 Cillik ..... A61F 13/74 604/398
5,819,323 A * 10/1998 Edenfield ..... A41B 9/02 2/403
6,018,823 A * 2/2000 Ortmeier ..... A41D 27/20 450/150
6,023,789 A * 2/2000 Wilson ..... A41D 1/089 2/404
6,076,195 A * 6/2000 Klein ..... A41B 9/023 2/403
6,605,071 B1 * 8/2003 Gray ..... A61F 13/505 604/385.03
6,760,926 B1 * 7/2004 Miller ..... A41D 27/201 2/250
8,123,735 B2 * 2/2012 Deerin ..... A61F 13/505 604/385.15
8,321,964 B2 * 12/2012 Gernes ..... A41B 9/001 2/403
8,777,918 B2 * 7/2014 Kuwano ..... A61F 13/496 604/394
8,992,498 B2 * 3/2015 Labit ..... A61F 13/505 604/385.15
D726,394 S * 4/2015 Watson ..... D2/857
9,003,571 B1 * 4/2015 Lewis-Williams ..... A41B 9/04 2/400
9,226,862 B2 * 1/2016 Orchard, IV ..... A61F 13/496
9,308,131 B2 * 4/2016 Evenson ..... A61F 13/49004
9,474,655 B1 * 10/2016 Biondolillo ..... A41B 9/04
11,278,459 B2 * 3/2022 Godfrey ..... A61F 13/474
11,529,252 B2 * 12/2022 Glithero ..... A61F 5/4408
2001/0053902 A1 * 12/2001 Roe ..... A61F 13/15 604/385.01
2003/0093055 A1 * 5/2003 Elfstrom ..... A61F 13/496 604/385.25
2003/0109841 A1 * 6/2003 Edwards ..... A61F 13/84 604/385.06
2004/0039361 A1 * 2/2004 LaVon ..... A61F 13/51498 604/385.01
2005/0065494 A1 * 3/2005 Harriott ..... A61F 13/491 604/396
2005/0090795 A1 * 4/2005 Coleman ..... A61F 13/505 604/387
2005/0090796 A1 * 4/2005 Coleman ..... A61F 13/49012 604/387
2005/0137548 A1 * 6/2005 Riley ..... A61F 13/8405 604/385.01
2006/0101558 A1 * 5/2006 Coleman ..... A61F 13/84 2/400
2008/0103472 A1 * 5/2008 LaVon ..... A61F 13/496 604/361
2008/0110775 A1 * 5/2008 Beck ..... A61F 13/505 206/229
2008/0189832 A1 * 8/2008 Oscher ..... A41D 7/005 2/400
2008/0228157 A1 * 9/2008 McKiernan ..... A61F 13/42 604/361
2009/0270822 A1 * 10/2009 Medeiros ..... A61F 5/451 604/347
2010/0125264 A1 * 5/2010 Naylor ..... A61F 13/491 604/385.29
2010/0281595 A1 * 11/2010 Gernes ..... A41B 9/001 2/69
2012/0029462 A1 * 2/2012 Dobrin ..... A61F 13/565 604/389
2018/0177242 A1 * 6/2018 Johnson ..... A61M 1/285
2018/0368482 A1 * 12/2018 Chea ..... A41B 9/04
2019/0254369 A1 * 8/2019 Crespo ..... A41D 27/208
2019/0262197 A1 * 8/2019 Stewart ..... A61F 13/15585
2021/0393446 A1 * 12/2021 Arizti ..... A61F 13/42
2021/0393447 A1 * 12/2021 Arizti ..... A61F 13/42
2022/0031523 A1 * 2/2022 Pierpoint ..... A61F 13/51456
2022/0031528 A1 * 2/2022 Grenier ..... A61F 13/536
2022/0096286 A1 * 3/2022 Kurt ..... A61F 13/49004
2022/0331172 A1 * 10/2022 Fennell ..... A61F 13/5512
2023/0346059 A1 * 11/2023 Grimm ..... A41D 27/02

* cited by examiner

INCONTINENCE UNDERGARMENT AND INCONTINENCE SYSTEM

CROSS-REFERENCE TO RELATED APPLICATION

This nonprovisional patent application claims priority to U.S. Provisional Application No. 63/453,400 filed Mar. 20, 2023 and titled INCONTINENCE PANTIE WITH POCKET FOR HOLDING SPARE PAD, which is hereby incorporated by reference in its entirety.

TECHNICAL FIELD AND BACKGROUND

The present disclosure relates generally to managing incontinence, and more particularly, to an incontinence undergarment including provisions for holding an absorbent pad and a spare absorbent pad.

Incontinence is a common and distressing problem that affects quality of life. Incontinence may be caused by a variety of factors, some of which include bladder function, stress, congenital defects, stroke, and aging. While some forms of incontinence are treatable with medication or surgery, other forms are not and therefore must be managed.

Incontinence management may involve fluid capture. In this regard, undergarments have been developed that incorporate materials configured to absorb leaked fluid. Such undergarments rely on close-fitting engagement and positional relationships of the absorbent materials with predetermined target areas of likely fluid release. When undergarments shift, these absorbent materials tend to move out of position and therefore allow fluid to escape.

The type and form of absorbent material used may depend on the type of undergarment. For example, disposable undergarments may incorporate absorbent material in the layers of the undergarment, whereas reusable undergarments may use a strategically positioned disposable pad. To minimize bulk, reusable undergarments may position the disposable pad only at the area(s) of likely fluid release. Considering disposable pads have a maximum fluid capacity, they must be changed regularly. Having to carry extra pads further increases the burden of having to manage incontinence.

Therefore, what is needed is an incontinence solution, and more particularly a reusable system, that maintains an absorbent pad in position for fluid capture while also providing a provision for holding a spare pad.

BRIEF SUMMARY

In a first aspect, the inventive concepts according to the present disclosure are directed to an incontinence undergarment including a main body having a front portion, a back portion, a groin portion, a waist opening, and two leg openings. The incontinence undergarment further includes a sling positioned at depth in the main body, the sling having opposing ends attached to the front and back portions of the main body, and a middle portion free of attachment to the groin portion, the middle portion forming a first pocket configured to hold an absorbent pad. A second pocket is formed in the main body at one of the opposing ends of the sling, the second pocket having an opening positioned at the waist opening of the main body, and the second pocket configured to hold a spare absorbent pad.

In some embodiments, the second pocket is elongated in a direction transverse to a longitudinal length of the sling.

In some embodiments, the width of the second pocket is substantially equal to the width of the sling, and the length of the first pocket is substantially twice the length of the second pocket.

In some embodiments, the first pocket is dimensioned to hold the absorbent pad in an unfolded state, and the second pocket is dimensioned to hold the spare absorbent pad in a folded state.

In some embodiments, one end of the sling extends upward along one of the front portion and the back portion to meet the waist opening, the one end of the sling forms the second pocket, and a cross-stitch transverse across the sling delimits a separation between the first pocket and the second pocket.

In some embodiments, the second pocket is formed between the main body and an inner layer positioned in and sewn to the main body, and each of the main body and the inner layer, adjacent the waist opening, are elasticized.

In some embodiments, an opening into each of the first pocket and the second pocket is elasticized.

In some embodiments, the main body comprises elasticized material, the sling comprises elasticized material, and the elasticity of the main body material is greater than the elasticity of the sling material.

In some embodiments, at least two of the front portion, the back portion, and the groin portion are integrally formed.

In some embodiments, stitching forming a bottom of the second pocket further attaches one end of the sling to the main body.

In a second aspect, the inventive concepts according to the present disclosure are directed to an incontinence system including an incontinence undergarment including a main body and a suspended sling positioned within and attached to the main body. The suspended sling forms a first pocket and the main body includes a second pocket positioned al one end of the suspended sling. An absorbent pad is removably positioned in the first pocket in a fluid impingement region, and a spare absorbent pad is positioned in the second pocket out of a fluid impingement region.

In some embodiments, the second pocket is an extension of one end of the suspended sling and a cross-stitch delimits a separation between the first pocket and the second pocket.

In some embodiments, the first pocket is dimensioned to hold the absorbent pad in an unfolded state and the second pocket is dimensioned to hold the spare pad in a folded state, for instance folded in half.

In some embodiments, at least one of the absorbent pad and the spare absorbent pad includes a first pad portion and a second pad portion attached together by material forming a flexible hinge allowing the at least one of the absorbent pad and the spare absorbent pad to be folded in half.

In some embodiments, at least one of the absorbent pad and the spare absorbent pad includes a first pad including an elasticized band attached to the first pad transverse to a longitudinal length of the first pad, and a second pad positioned on the first pad, aligned therewith, and held in place on the first pad by the elasticized band.

BRIEF DESCRIPTION OF THE DRAWINGS

Implementations of the inventive concepts disclosed herein may be better understood when consideration is given to the following detailed description thereof. Such description refers reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

The description set forth below in connection with the appended drawings is intended to be a description of various, illustrative embodiments of the disclosed subject matter. Specific features and functionalities are described in connection with each illustrative embodiment; however, it will be apparent to those skilled in the art that the disclosed embodiments may be practiced without each of those specific features and functionalities. The aspects, features and functions described below in connection with one embodiment are intended to be applicable to the other embodiments described below except where expressly stated or where an aspect, feature or function is incompatible with an embodiment.

Broadly, the present disclosure is directed to incontinence undergarments and incontinence systems. In embodiments, the undergarments include a main body and an attached suspended sling forming a first pocket for holding a first absorbent pad, and a second pocket positioned at one end of the suspended sling for holding a second or spare absorbent pad. In use, the first pocket is positioned in a fluid impingement region (e.g., groin) and the second pocket is positioned away from the fluid impingement region (e.g., lower back or lower stomach). In embodiments, the second pocket may be an extension of one end of the suspended sling, and the second pocket is dimensioned to hold the spare absorbent pad in a folded state.

Figure 1:
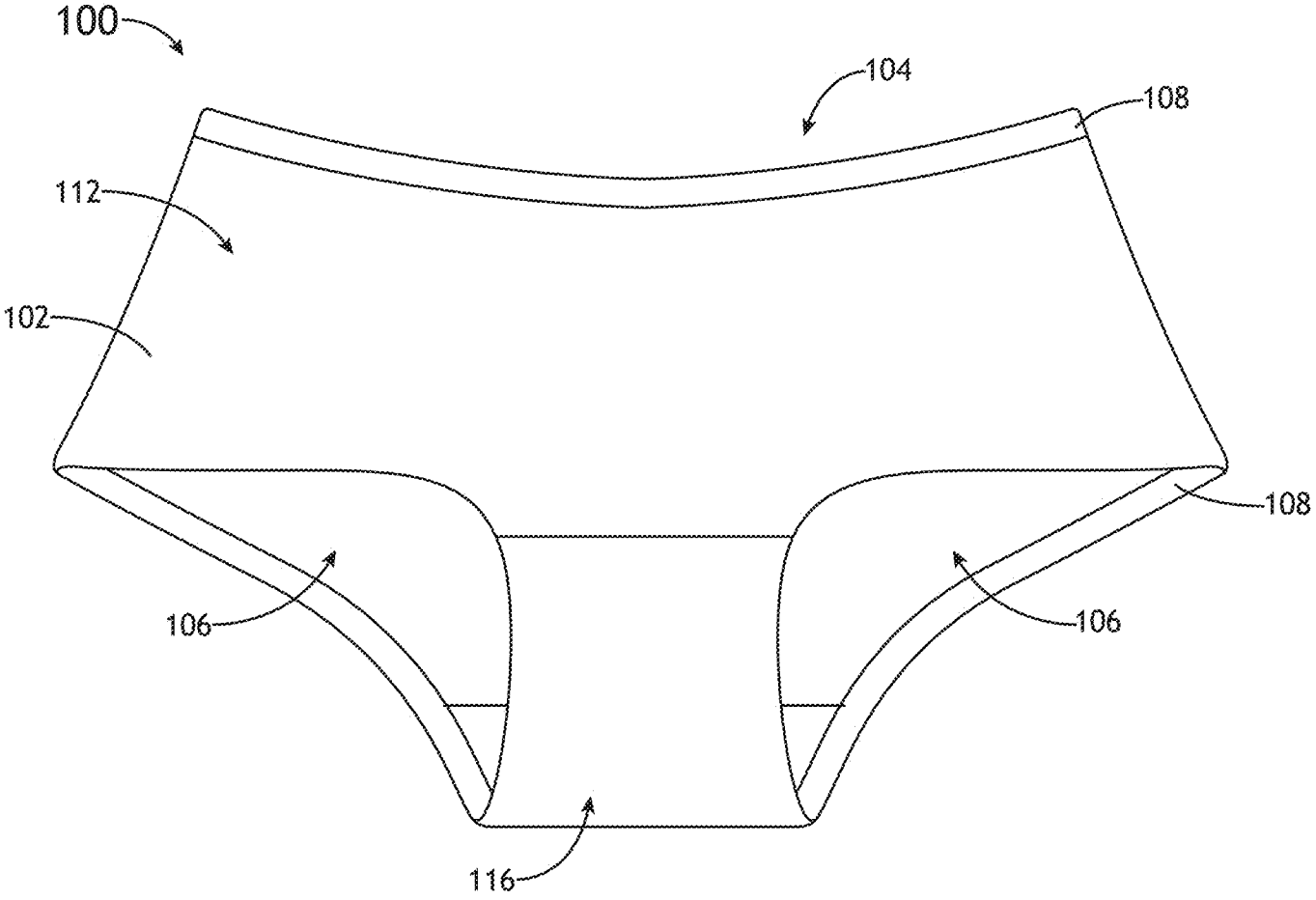
FIG. 1 is a front view of an incontinence undergarment according to a first embodiment of the present disclosure.
Figure 2:
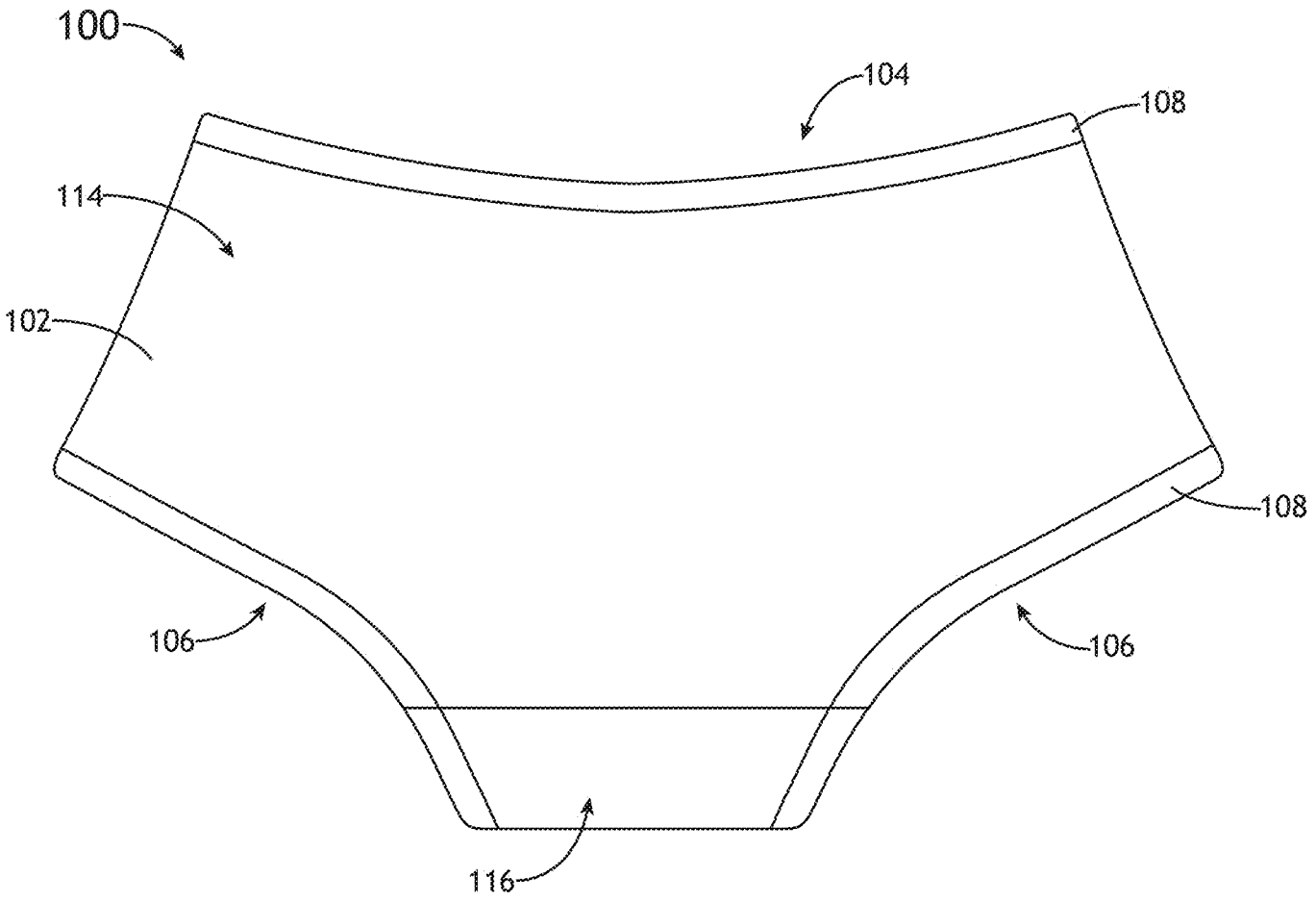
FIG. 2 is a back view of the incontinence undergarment according to the first embodiment.

FIGS. 1 and 2 illustrate an incontinence undergarment 100 according to a first embodiment. As shown, the incontinence undergarment is implemented as a pantie. The incontinence undergarment 100 generally includes a main body 102 forming a waist opening 104 and two leg openings 106. At least one of the waist opening 104 and the two leg openings 106 may include elastic banding 108 to maintain a tight fit. The main body 102 may be made from a soft textile material, for instance cotton, formed by one or more layers. The size and shape of the main body 102 may vary. The main body 102 is reusable and configured to be washed. FIG. 2 shows stitching 110 forming the second pocket as discussed below. As shown, the second pocket 110 extends across the width of the back of the main body 102 and partway down the length of the main body 102. In embodiments, the main body 102 generally includes a front portion 112, a back portion 114, and a groin portion 116, at least two of which may be integrally formed.

Figure 3:
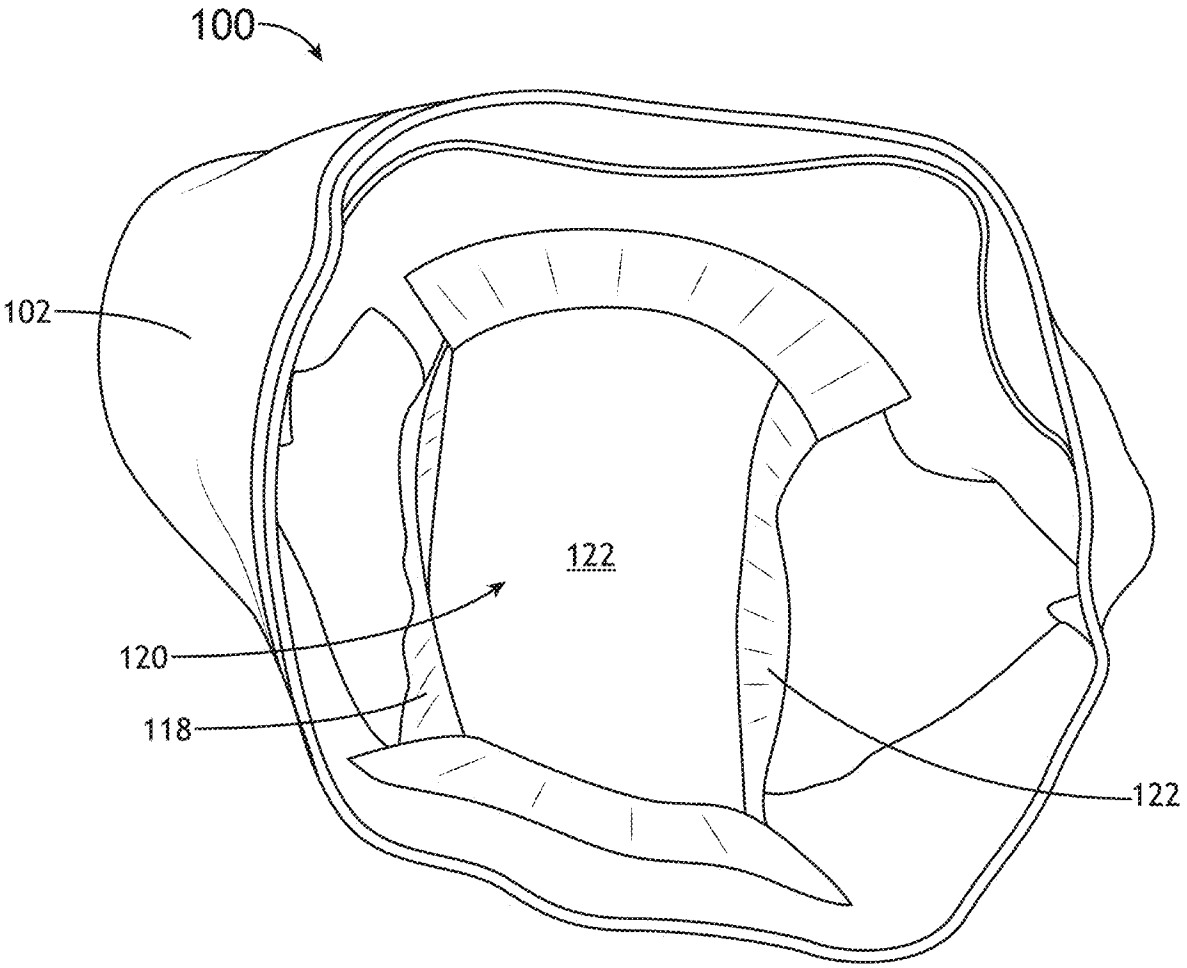
FIG. 3 is an interior view of the incontinence undergarment according to the first embodiment showing the first pocket and absorbent pad.

FIG. 3 illustrates the interior of the incontinence undergarment 100. A suspended sling 118 extends from front to back of the main body 102, is generally positioned about the groin area 116, and is free of attachment to the groin area 116 in order to be suspended at depth within the main body 102. The sling 118 forms a first pocket 120 configured to hold a removable absorbent pad 122. In some embodiments, the opening into the first pocket 120 is formed by an elastic band 122. The opposing ends of the sling 118 are attached, for instance sewn, to the inside of the respective front and back portions of the main body 102. In some embodiments, the sling 118 may attach to the main body 102 using removable fasteners, for instance hook-and-loop fasteners, such that the sling 118 can be installed and removed from the main body 102.

Figure 4:
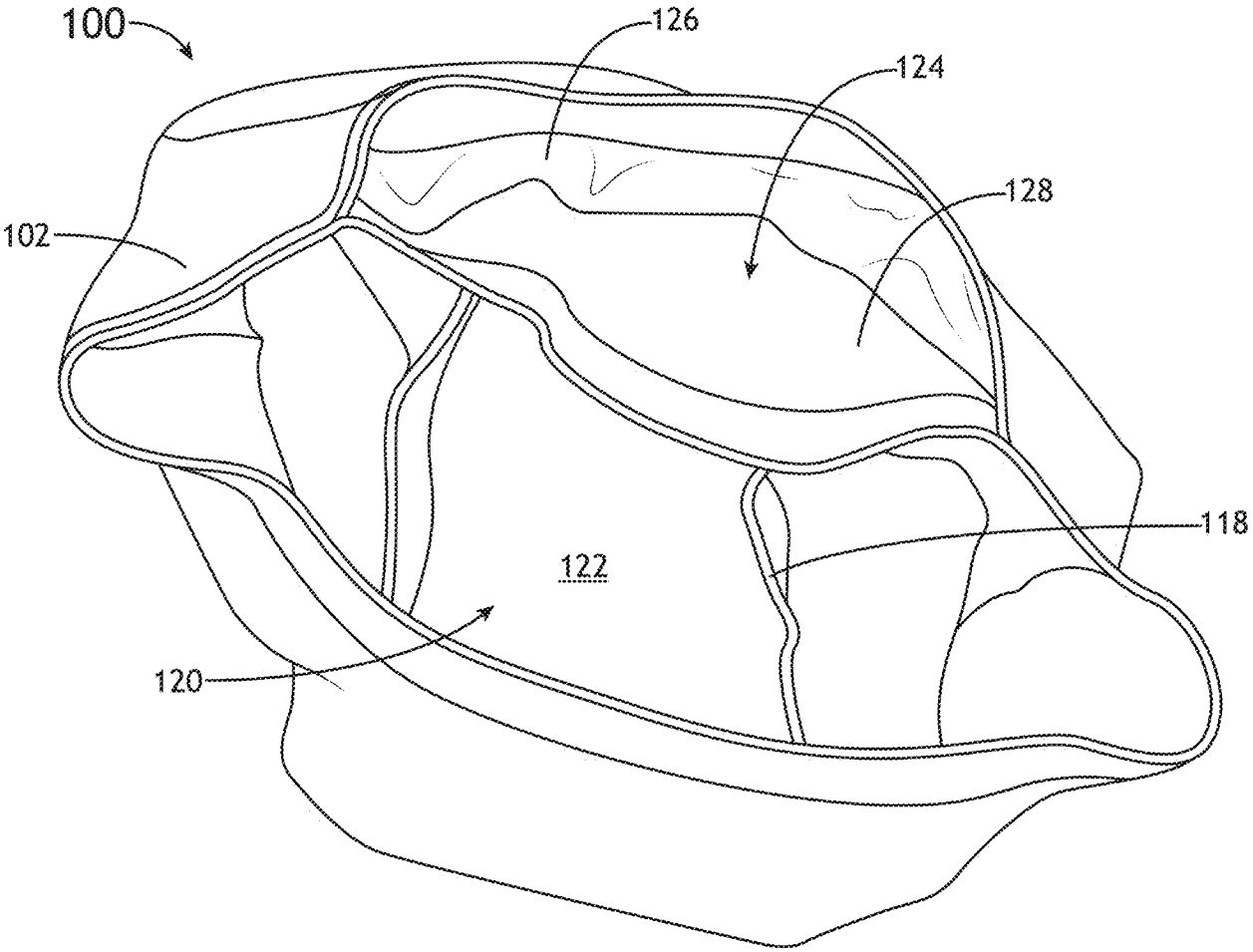
FIG. 4 is an interior view of the incontinence undergarment according to the first embodiment showing the second pocket and spare absorbent pad.

FIG. 4 illustrates a second pocket 124 formed inside the main body 102 for holding a spare absorbent pad 126. In a preferred embodiment, the second pocket 124 may be positioned on the inside of the back portion of the main body 102 out of the way of a likely fluid leakage area. As shown, the opening to the second pocket 124 extends along the waistband such that the outer layer of the second pocket 124 is formed by the main body 102, and the inner layer 128 of the second pocket 124 is formed by a separate layer of material, for instance made from the same material as the main body 102. The second pocket 124 is dimensioned to accommodate at least one spare absorbent pad 126 for replacement in the sling 118 as needed. As shown, the first pocket 120 formed by the sling 118 is elongated in the front to back direction, whereas the second pocket 124 is elongated in a transverse direction, for instance across the back portion or across the front portion depending on the second pocket location. In this configuration, the second pocket 124 may be sufficiently elongated to hold the spare absorbent pad 126 in an unfolded state. In embodiments, the waistband and the inner layer 128 forming the second pocket 126 may both be elasticized such that the inner layer 128 enhances a tight-fit at the waist.

Figure 5:
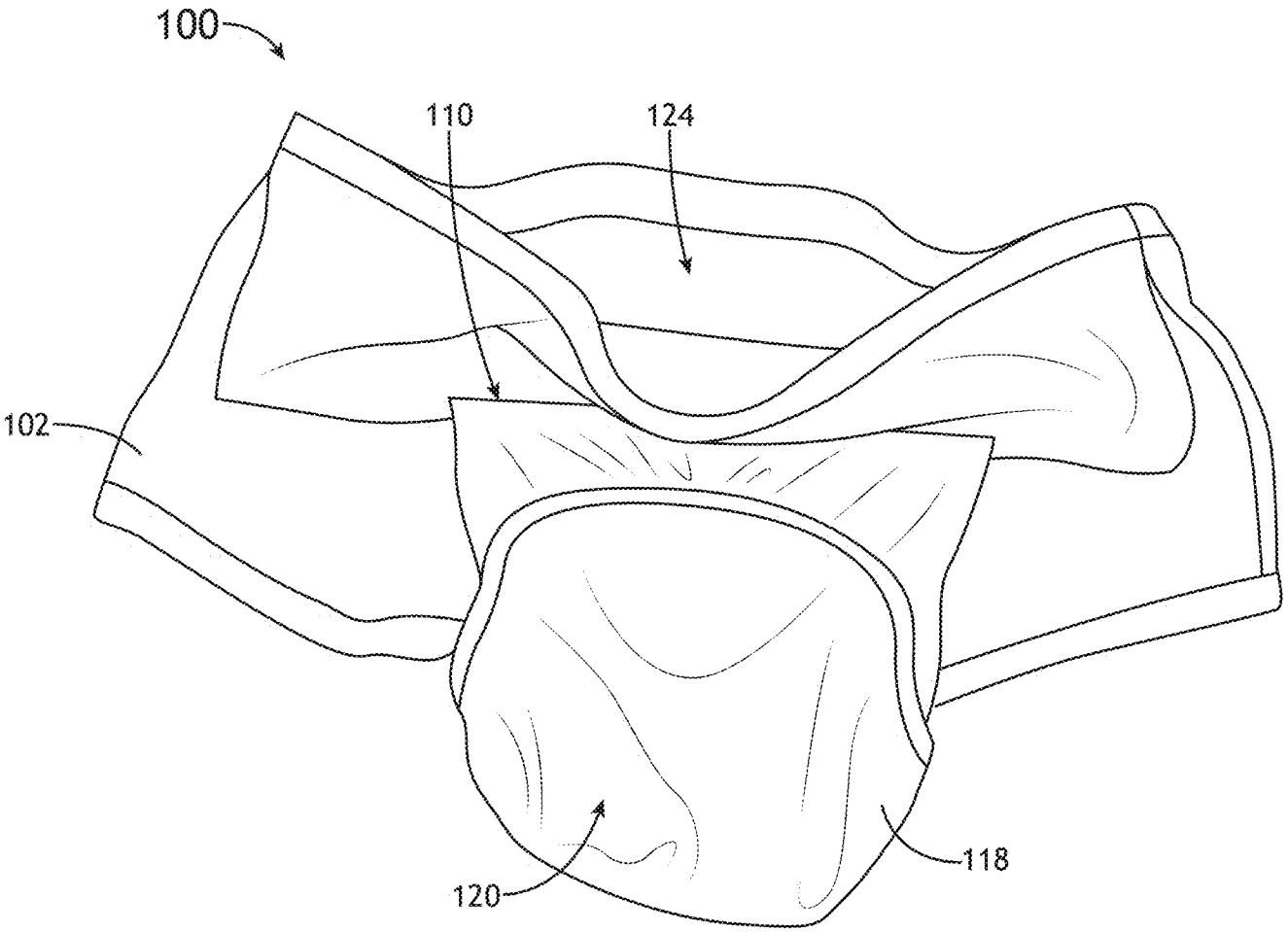
FIG. 5 shows the incontinence undergarment according to the first embodiment turned inside out to show the positional relationship between the sling and the second pocket.

FIG. 5 illustrates the incontinence undergarment 100 turned inside-out. In some embodiments, the transverse stitching 110 forming the bottom of the second pocket 124 also secures one end of the sling 118 to the main body 102, thereby reinforcing the sling attachment to prevent the sling from being ripped from the main body 102, while also delimiting the separation between the first and second pockets 120, 124. In some embodiments, the second pocket 124 may be located inside the front of the main body 102. In a further embodiment, the incontinence undergarment 100 may include a third pocket at the other of the front portion or the back portion such that two spare absorbent pads can be carried, or a single spare absorbent pad can be carried at the preferred pocket of the user. In embodiments, the opening to the second pocket 124 may be closable using a fastener, for instance a zippered opening or hook-and-loop fasteners.

Figure 6:
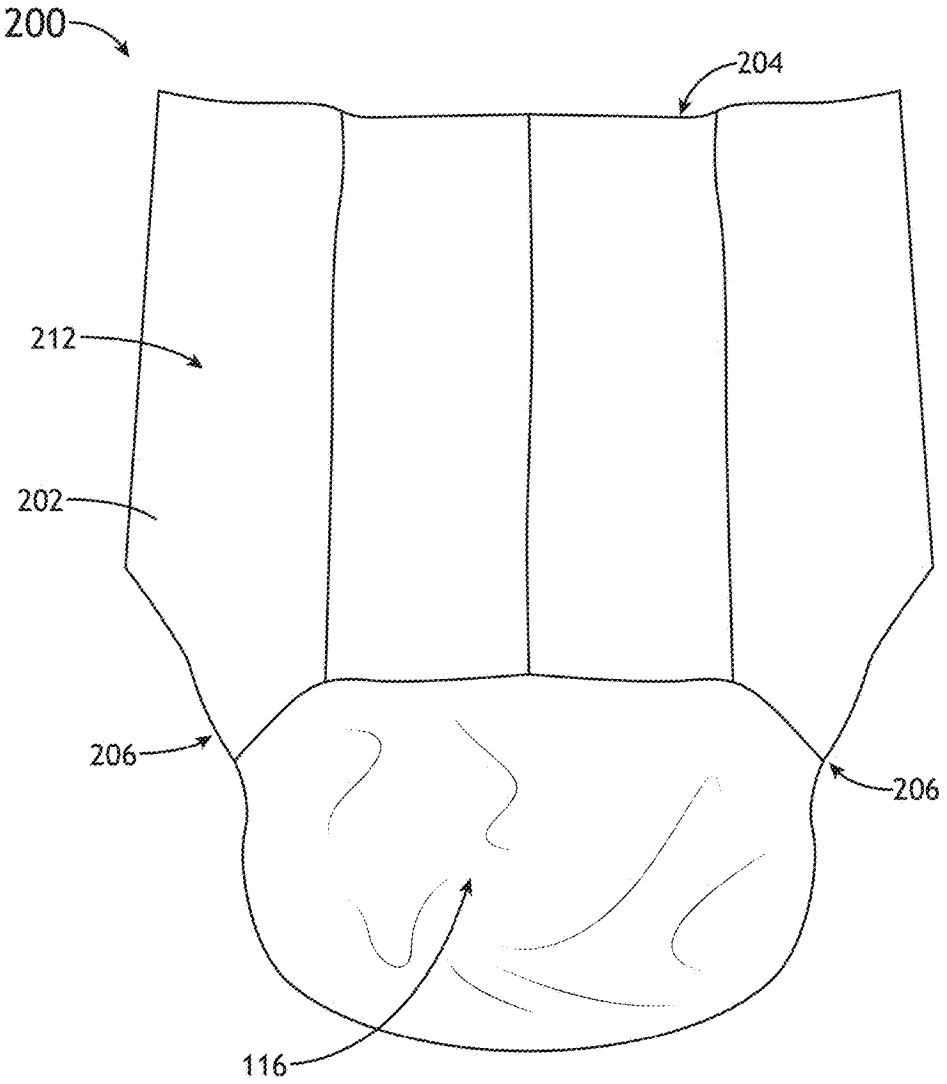
FIG. 6 is a front view of an incontinence undergarment according to a second embodiment of the present disclosure.
Figure 7:
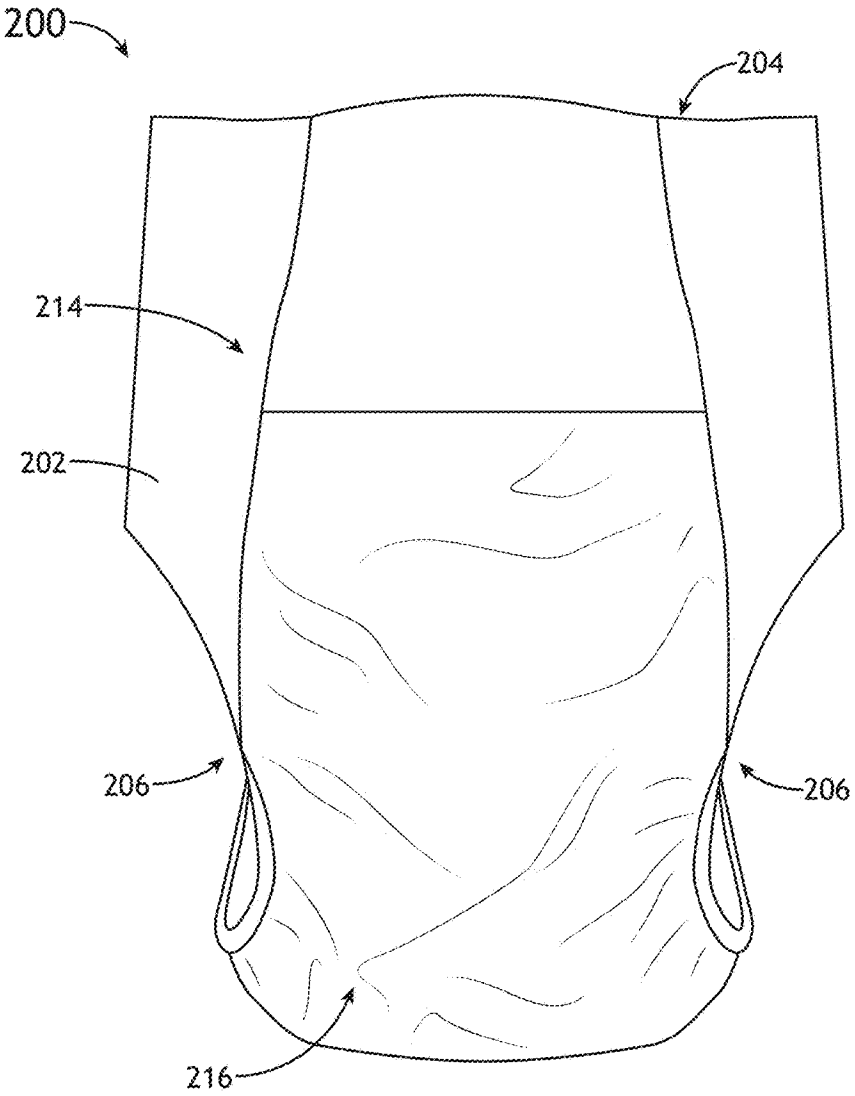
FIG. 7 is a back view of the incontinence undergarment according to the second embodiment.
Figure 8:
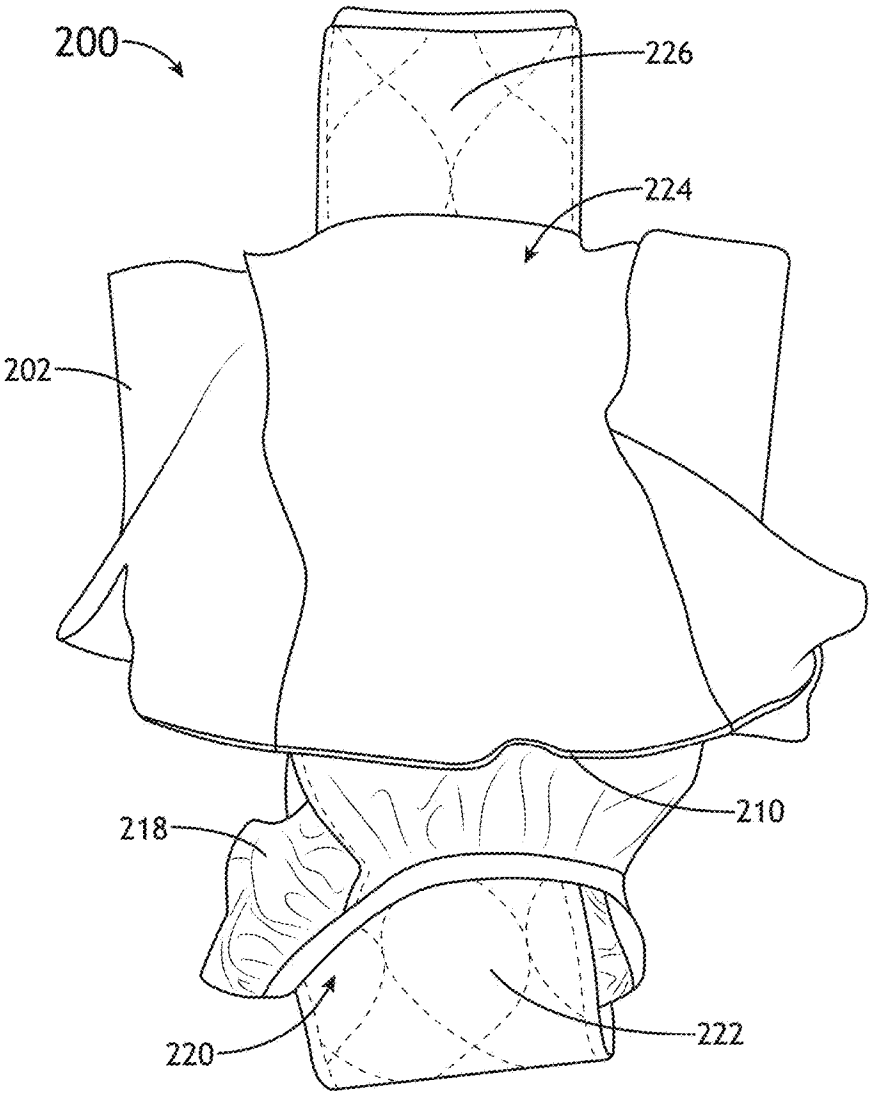
FIG. 8 shows the incontinence undergarment according to the second embodiment turned inside out to show the positional relationship between the sling and the second pocket and the absorbent pads disposed in the pockets.

FIGS. 6-8 illustrate an incontinence undergarment 200 according to a second embodiment. As shown, the incontinence undergarment 200 is implemented as a tall pantie. The incontinence undergarment 200 also generally includes a main body 202 forming a waist opening 204 and two leg openings 206, at least one of which may include elastic banding to maintain a tight fit. The main body 202 may be made from a highly elastic and stretchable material having a greater elasticity than the material forming the sling. The main body 202 is reusable and configured to be washed. In embodiments, the main body 202 generally includes a front portion 212, a back portion 214, and a groin portion 216, at least two of which may be integrally formed.

With specific reference to FIG. 8 showing the incontinence undergarment 200 turned inside out, the first pocket 220 is formed by the sling 218 and is configured to hold an absorbent pad 222 in a fluid impingement area. The second pocket 224 is positioned at one end of the sling 218 and holds a spare absorbent pad 226. In embodiments, the width of the second pocket 224 is substantially equal to the width of the sling 218, and the length of the first pocket 220 is substantially twice the length of the second pocket 224. In this configuration, the first pocket 220 is dimensioned to hold the absorbent pad 222 in an unfolded state for use, and the second pocket 224 is dimensioned to hold the spare absorbent pad 226 in a folded state for storage. In embodiments, one end of the sling 218 may extend upward along one of the front portion and the back portion to meet the waist opening, the one end of the sling 218 extending upward forms the second pocket 220, and a cross-stitch 210 transverse across the sling 218 delimits a separation between the first pocket 220 and the second pocket 224.

Figure 9:
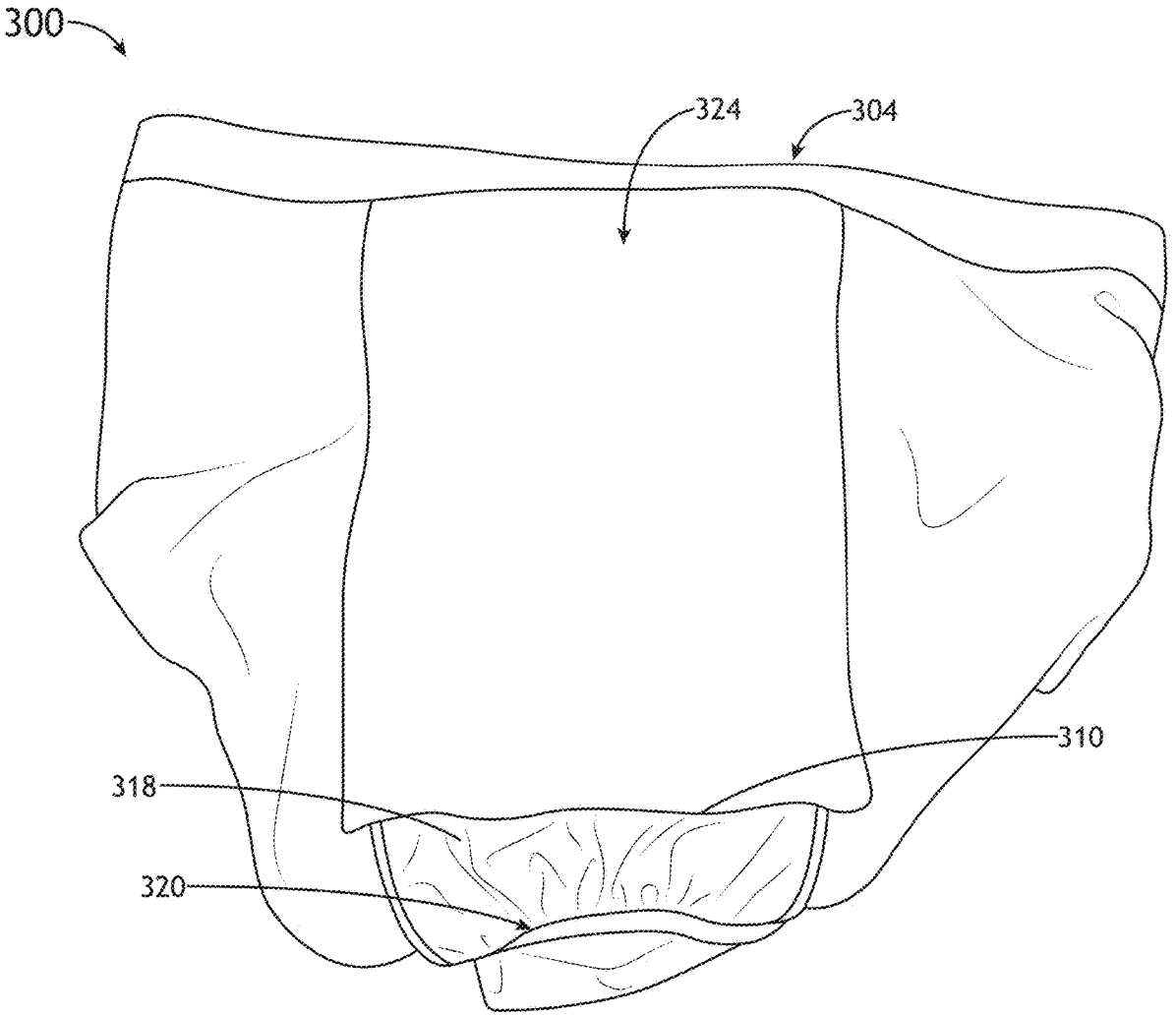
FIG. 9 show an incontinence undergarment according to a third embodiment turned inside out to show the positional relationship between the sling and the second pocket.

FIG. 9 illustrates an incontinence undergarment 300 according to a third embodiment. As shown, the incontinence undergarment 300 is implemented as a brief. The incontinence undergarment 300 includes substantially the same features and the first and second undergarments 100, 200 described above. The incontinence undergarment 300 is shown turned inside out to show the second pocket 324 formed as an extension of one end of the sling 318 extending upward to about the waist opening 304. Again, the first pocket 320 is formed by the sling 318 and is configured to hold an absorbent pad in a fluid impingement area, and the second pocket 324 is positioned at one end of the sling 318 and holds a spare absorbent pad. In embodiments, the width of the second pocket 324 is substantially equal to the width of the sling 318, and the length of the first pocket 320 is substantially twice the length of the second pocket 324. In this configuration, the first pocket 320 is dimensioned to hold the absorbent pad in an unfolded state for use, and the second pocket 324 is dimensioned to hold the spare absorbent pad in a folded state for storage. In embodiments, one end of the sling 318 extends upward to about the waist opening 304, the one end of the sling 318 extending upward forms the second pocket 320, and a cross-stitch 310 transverse across the sling 318 delimits a separation between the first pocket 320 and the second pocket 324.

Figure 10B:
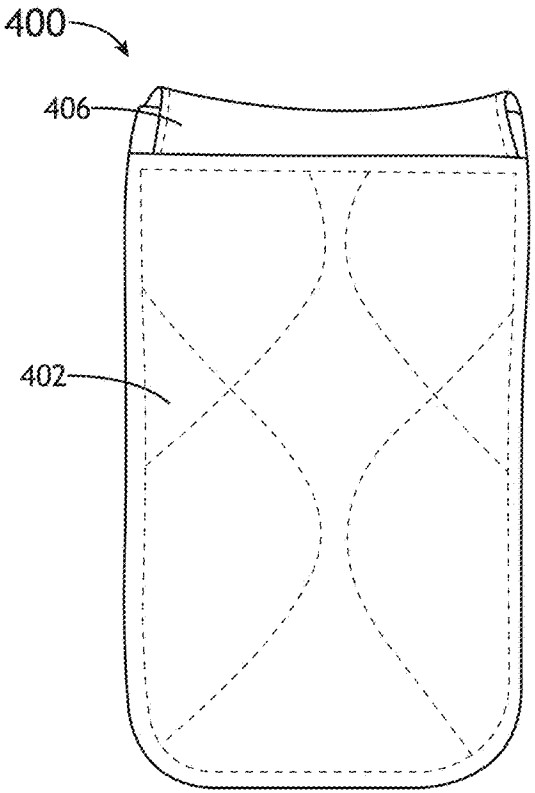
FIGS. 10A and 10B illustrate an absorbent pad according to a first embodiment shown in an unfolded state and a folded state, respectively.
Figure 10A:
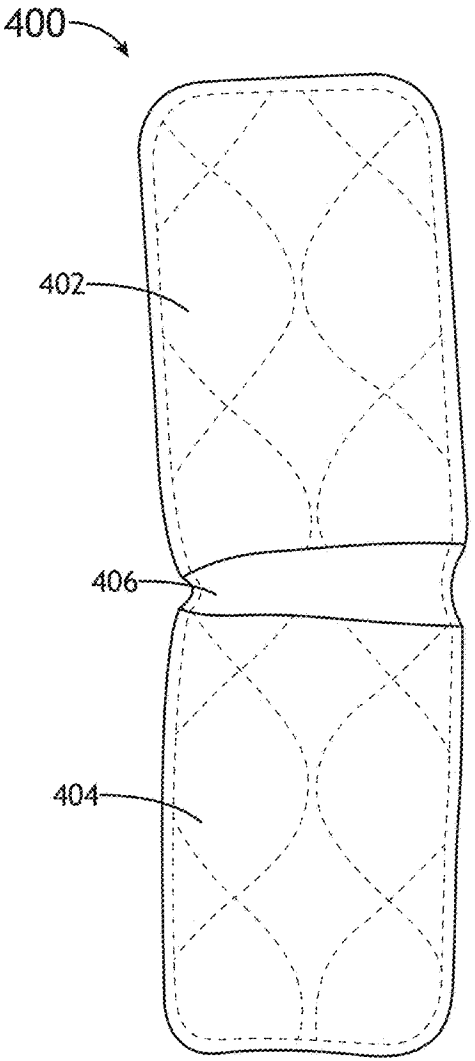

FIGS. 10A and 10B illustrate a first embodiment of at least one of the absorbent pad and the spare absorbent pad. As shown, the absorbent pad 400 includes a first pad portion 402 and a second pad portion 404 attached together by material forming a flexible hinge 406 that allows the absorbent pad 400 to be folded in half to be stored in the second pocket of one of the undergarment embodiments described above. In embodiments, the absorbent pad 400 may be made from material intended to be washed or material intended to be disposable. FIG. 10A shows the absorbent pad 400 in the unfolded state for use in the first pocket for fluid capture. FIG. 10B shows the absorbent pad 400 in the folded state for storage in the second pocket.

Figure 11B:
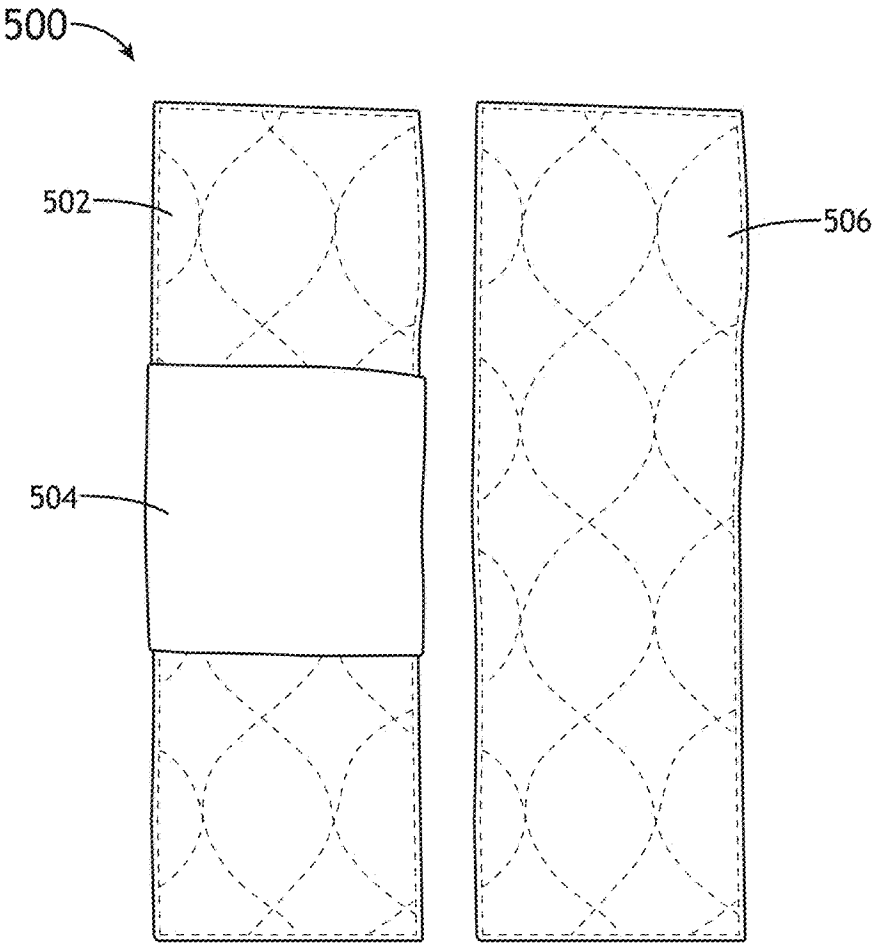
FIGS. 11A and 11B illustrate an absorbent pad according to a second embodiment shown in an assembled state and a disassembled state, respectively.
Figure 11A:
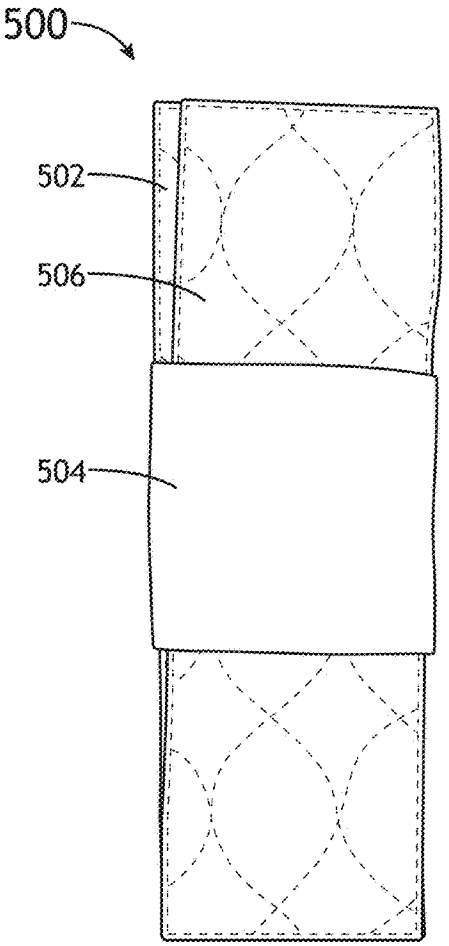

FIGS. 11A and 11B illustrate a second embodiment of at least one of the absorbent pad and the spare absorbent pad. As shown, the absorbent pad 500 includes a first pad 502 including an elasticized band 504 attached to the first pad 502 transverse to a longitudinal length of the first pad 502, and a second pad 504 positioned on the first pad 502, aligned therewith, and held in place on the first pad 502 by the elasticized band 504. With this configuration, the user has the option of using one or two pads overlaid depending on the amount of fluid absorbency needed.

From the above description, it is clear that the inventive concepts disclosed herein are well adapted to achieve the objectives and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. An incontinence system, comprising:

an incontinence undergarment including:

a main body having a front portion, a back portion, a groin portion, a waist opening, and two leg openings;

a sling positioned at depth in the main body, the sling having opposing ends attached to the front and back portions of the main body, a middle portion free of attachment to the groin portion, and the middle portion forming a first pocket; and a second pocket positioned in the main body at one of the opposing ends of the sling, the second pocket having an opening positioned at the waist opening of the main body;

an absorbent pad positioned in the first pocket; and a spare absorbent pad positioned in the second pocket, wherein at least one of the absorbent pad and the spare absorbent pad comprises:

a first pad including an elasticized band attached to the first pad transverse to a longitudinal length of the first pad; and a second pad positioned on the first pad, aligned therewith, and held in place on the first pad by the elasticized band.

2. The incontinence system according to claim 1, wherein the first pocket is elongated from the front portion to the back portion, and the second pocket is elongated in a direction perpendicular to the first pocket.

3. The incontinence system according to claim 1, wherein:

a width of the second pocket is equal to a width of the sling; and a length of the first pocket is twice a length of the second pocket.

4. The incontinence system according to claim 3, wherein:

the first pocket is dimensioned to hold the absorbent pad in an unfolded state; and the second pocket is dimensioned to hold the spare absorbent pad in a folded state.

5. The incontinence system according to claim 1, wherein:

one end of the sling extends upward along one of the front portion and the back portion to meet the waist opening;

the one end of the sling forms the second pocket; and a cross-stitch positioned transverse across the sling delimits a separation between the first pocket and the second pocket.

6. The incontinence system according to claim 1, wherein;

the second pocket is formed between the main body and an inner layer positioned in and sewn to the main body; and each of the main body and the inner layer, adjacent the waist opening, are elasticized.

7. The incontinence system according to claim 1, wherein at least one of the absorbent pad and the spare absorbent pad comprises a first pad portion and a second pad portion attached together by material forming a flexible hinge allowing the at least one of the absorbent pad and the spare absorbent pad to be folded in half.

8. The incontinence system according to claim 1, wherein:

the main body comprises elasticized material;

the sling comprises elasticized material; and elasticity of the main body is greater than elasticity of the sling.

9. The incontinence system according to claim 1, wherein stitching forming a bottom of the second pocket further attaches one end of the sling to the main body.

* * * * *